US005886277A

United States Patent [19]

Takauji

[11] Patent Number: 5,886,277

[45] Date of Patent: Mar. 23, 1999

[54] ELECTRONIC MUSICAL INSTRUMENT

[75] Inventor: Kiyomi Takauji, Hamamatsu, Japan

[73] Assignee: Kawai Musical Instruments Manufacturing Co., Ltd., Hamamatsu, Japan

[21] Appl. No.: 826,430

[22] Filed: Mar. 18, 1997

[30] Foreign Application Priority Data

Mar. 19, 1996 [JP] Japan ..... 8-088958

[51] Int. Cl.[6] ..... G10H 7/00

[52] U.S. Cl. ..... 84/604; 84/601; 84/603; 84/609

[58] Field of Search ..... 84/601–606, 609, 84/622–625

[56] References Cited

U.S. PATENT DOCUMENTS 5,264,657 11/1993 Takauji ..... 84/607

FOREIGN PATENT DOCUMENTS 2282297 11/1990 Japan .

*Primary Examiner*—William M. Shoop, Jr.
*Assistant Examiner*—Marlon T. Fletcher
*Attorney, Agent, or Firm*—Christie, Parker & Hale, LLP

[57] ABSTRACT

An electronic musical instrument having a waveform memory of a relatively small capacity for storing waveform information similar to conventional waveform information, the waveform memory being compatible with any data reading scheme. The waveform information is stored in the form of a plurality of frames. Each frame includes a plurality of pieces of sampled waveform data compressed by ADPCM or the like and decode information for extending the sampled waveform data to be read next to the current frame. Storing the decode information in a frame for extending the sampled waveform data stored in frames before and after that frame makes it possible to extract the necessary decode information from the frame read immediately before regardless of whether the frames are read forward or backward.

18 Claims, 6 Drawing Sheets

ELECTRONIC MUSICAL INSTRUMENT

BACKGROUND OF THE INVENTION

1. Field of the Invention

The present invention relates to an electronic musical instrument and, more particularly, to an electronic musical instrument capable of compressing waveform data for storage and reading out the stored data in any reading scheme.

2. Description of the Related Art

In a conventional synthesizer, an electronic piano, an electronic organ, an electronic single keyboard, and other electronic musical instruments, a musical tone generated by an acoustic musical instrument is recorded (as in PCM recording, for example) from the beginning of sound to the end thereof or up to a point at which there is little change in timbre, the recorded sound is processed so as to have desired characteristics, and the resultant waveforms are stored in a waveform memory. In reproduction, the stored data is read out of the memory at an address interval corresponding to the pitch for a pressed key, an envelope is given to the read data, and the enveloped data is sounded. Also, other sounding processing operations are practiced in a manner which the last half of a tone waveform is repeatedly read in the forward direction or in the backward direction, or in an alternate manner in which particular waveform ranges are read in both the directions alternately.

However, in the waveform storing system in the conventional electronic musical instruments, the sampled values themselves of a PCM-recorded waveform are stored over a plurality of periods, thereby requiring the waveform memory of a relatively large capacity.

SUMMARY OF THE INVENTION

It is therefore an object of the present invention to provide an electronic musical instrument having a waveform memory of a relatively small capacity that stores waveform information with generally the same precision as that of conventional counterparts and is compatible with any reading scheme for retrieving the stored waveform information.

The present invention is characterized in that there is provided an electronic musical instrument which generates a musical waveform signal from the waveform information stored in a waveform information memory, wherein the waveform information is stored in the waveform information memory in the form of blocks or frames each composed of a plurality of pieces of waveform data, each data block including sampled waveform data compressed by such a compression scheme as DPCM (Differential Pulse Code Modulation) or ADPCM (Adaptive Differential Pulse Code Modulation) along with extension or decode information for decoding the sampled waveform data stored in a block which is to read out after the data block concerned.

According to the present invention, the PCM waveform data is stored in a compressed form, requiring a memory of a relatively small capacity for storing generally the same size of tone waveform information as that stored in conventional electronic musical instruments. In addition, the information necessary for decoding the stored compressed data is stored in a data block in the memory such that the data necessary for decoding are ready at the moment for decode of a data block; namely, the decoding data is stored in a data block adjacent to the data block concerned for example. Therefore, if a data block stores the information for decoding the data blocks before and after that data block, the decode information necessary for decoding the sampled and compressed waveform data held in any data block can be extracted from the data held in a data block read immediately before that data block regardless of whether the data blocks are read forward or backward, thereby providing compatibility with any data reading scheme.

The above and other objects, features and advantages of the present invention will become more apparent from the accompanying drawings, in which like reference numerals are used to identify the same or similar parts in several views.

DETAILED DESCRIPTION OF THE PREFERRED EMBODIMENTS

Figure 2:
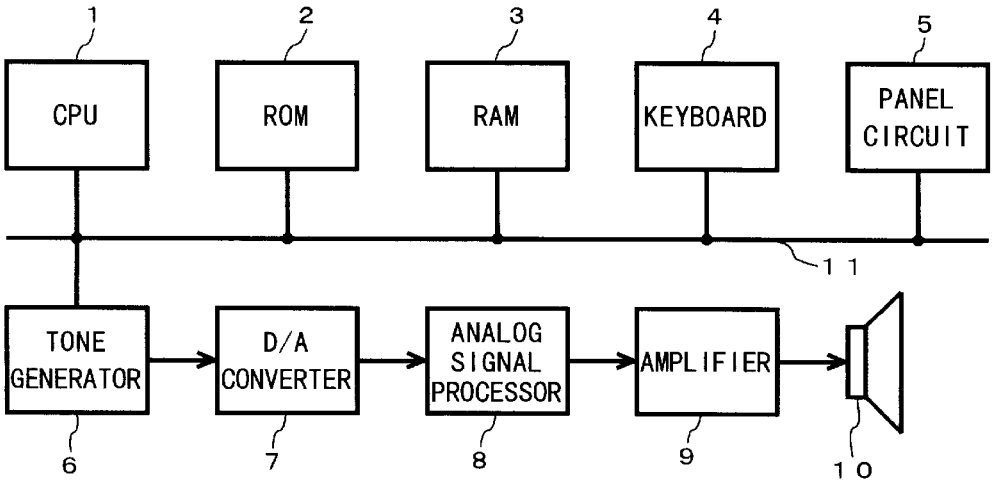
FIG. 2 is a block diagram illustrating an electronic musical instrument according to a first preferred embodiment of the present invention.

This invention will be described in further detail by way of example with reference to the accompanying drawings. FIG. 2 is a block diagram illustrating a constitution of an electronic piano associated with the present invention. A CPU (Central Processing Unit) 1 controls the electronic piano in its entirety based on a control program stored in a ROM 2. In addition to the control program, the ROM 2 stores timbre parameters, automatic playing data and others. A RAM 3, which may be backed up by a battery (not shown), serves as a work area and a buffer.

A keyboard 4 comprises a plurality of keys each having a pair of switches for example and a keyboard scanner for scanning the pair of switches of each key, detecting status change information and touch information associated therewith, and outputting the detected information to the CPU 1. A panel circuit 5 comprises switches for timbre selection and selection of musical piece automatically played, a display device for displaying characters and other information with a liquid crystal display device or light emitting diodes for example, and interface circuits thereof.

A tone generator 6 sequentially reads compressed data out of a waveform memory with an address interval in proportion to a pitch to be sounded in which memory the compressed data about digital musical sound waveforms are stored, then extends the compressed data read out to the original sampled values thereof, performs processing such as interpolation on these original sampled values, and generates a tone waveform signal. Details of the tone generator 6 will be described later.

Also, the tone generator 6 has an envelope signal generator for providing an envelope by multiplying the tone waveform signal by an envelope signal generated based on preset envelope parameters and outputting a resultant musical tone signal. Further, the tone generator 6 has a plurality of tone generating channels. To be more specific, the tone generator 6 is constituted such that a plurality of tone signals are independently generated substantially at the same time by operating these tone generating channels in a time division multiplex manner.

A D/A converter 7 converts a digital tone signal into an analog signal. An analog signal processor 8 filters the analog tone signal to eliminate a noise therefrom. The filtered tone information is amplified by an amplifier 9 to be sounded out of a speaker 10. A bus 11 interconnects the above-mentioned circuits constituting the electronic piano. The above-mentioned electronic piano may also include a memory card interface circuit, a floppy disk driver, a MIDI interface circuit and so on, as required.

Figure 1A:
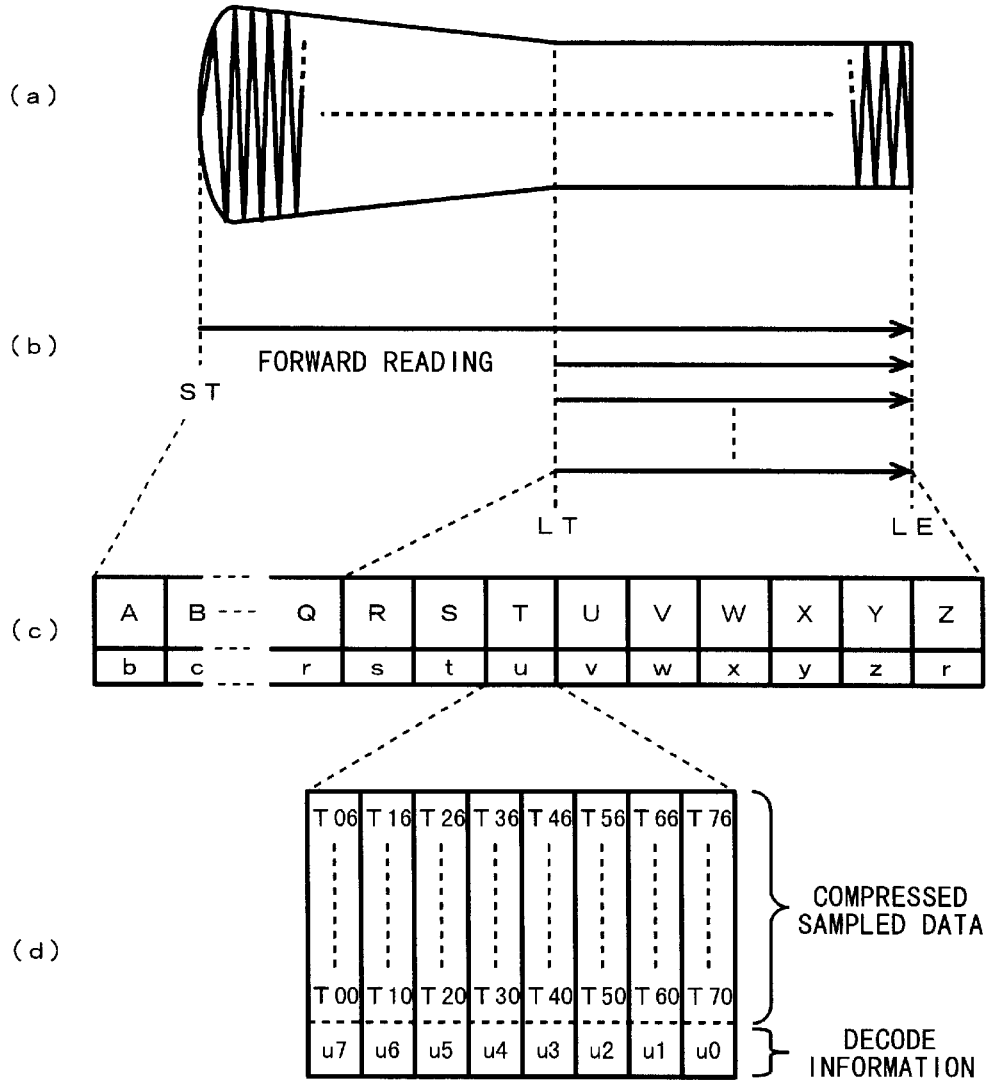
FIG. 1A is a diagram illustrating waveform data stored in the waveform memory and forward data reading schemes.

Referring to FIG. 1A, the waveform data stored in the waveform memory incorporated in the tone generator 6 of FIG. 2 is described. Generally, in storing the waveform data in the waveform memory, a musical tone generated by an acoustic musical instrument is first recorded (in PCM recording, for example). Then, the recorded tone is processed such that little change is found any more in amplitude and timbre (frequency spectrum) in a predetermined range (from loop top LT to a loop end LE) which is read out repeatedly and the amplitude is made substantially constant as shown in FIG. 1A. FIG. 1A(a) shows a schematic diagram illustrating an example of the tone signal processed as above mentioned.

To read out the above-mentioned tone waveform data to generate a tone waveform signal, reading of the data starts with the start address ST of the waveform and, when the end of the waveform, or the loop end is reached, the reading goes back to the loop top LT for forward reading as shown in FIG. 1A(b), in general. Thus, the waveform reading is repeated between the LT and the LE in forward direction.

In the present invention, as shown in FIG. 1A(c), waveform data is stored in the waveform memory in continuous units of blocks or frames (R through Z) obtained by dividing the waveform data by a predetermined number. Each of these frames has a data structure shown in FIG. 1A(d), for example. In this example, one frame consists of 8 bits×8 words, and 7 bits of Ti0 through Ti6 ("i" is an integer of 0~7) in each word representing a single compressed sampled data obtained by compressing a single tone sampled value, for example, by differential coding scheme, while ui represents one bit of predictive/quantization data stored in each word in a distributed manner. It should be seen that U0~U7 included in any one frame represent a single predictive quantization data.

The predictive/quantization data, namely decode information is used for extending or decoding the compressed data held in a corresponding frame. The decode information comprises predictive a coefficient information and a quantization width information. The decode information must be supplied to a differential data decoder before or at the same time reading of a frame starts. Therefore, as shown in FIG. 1A(c), the decode information corresponding to a frame to be read next is held in each adjacent frame (a frame expressed in an upper-case character corresponds to decode information expressed in a lower-case character). For example, as shown in FIG. 1A(c), the frame T holds decode information u for extending the data held in the immediately subsequent frame U and the decode information t for extending the data held in frame T is held in the immediately preceding frame S. The last frame or loop end Z in the repeatedly read division holds decode information r for extending the data held in the start frame or loop top R in that division.

Figure 1B:
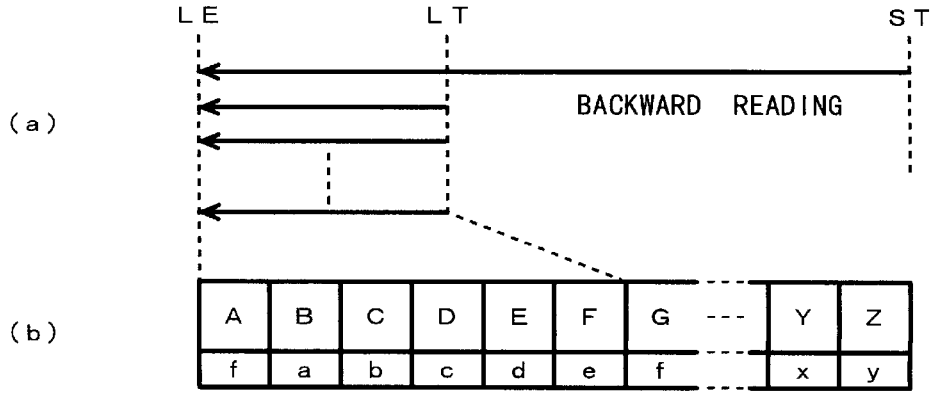
FIG. 1B is a diagram illustrating backward data reading schemes.

Referring to FIG. 1B(a) and (b), a relationship is shown between the frames and the decode information in a case of reading waveform data in backward direction. Backward reading of a waveform requires that decode information is held in the frame immediately after the frame to be extended. Therefore, the data combination in each frame in backward reading shown in FIG. 1B(b) is different from that in forward reading shown in FIG. 1A(c).

Figure 3:
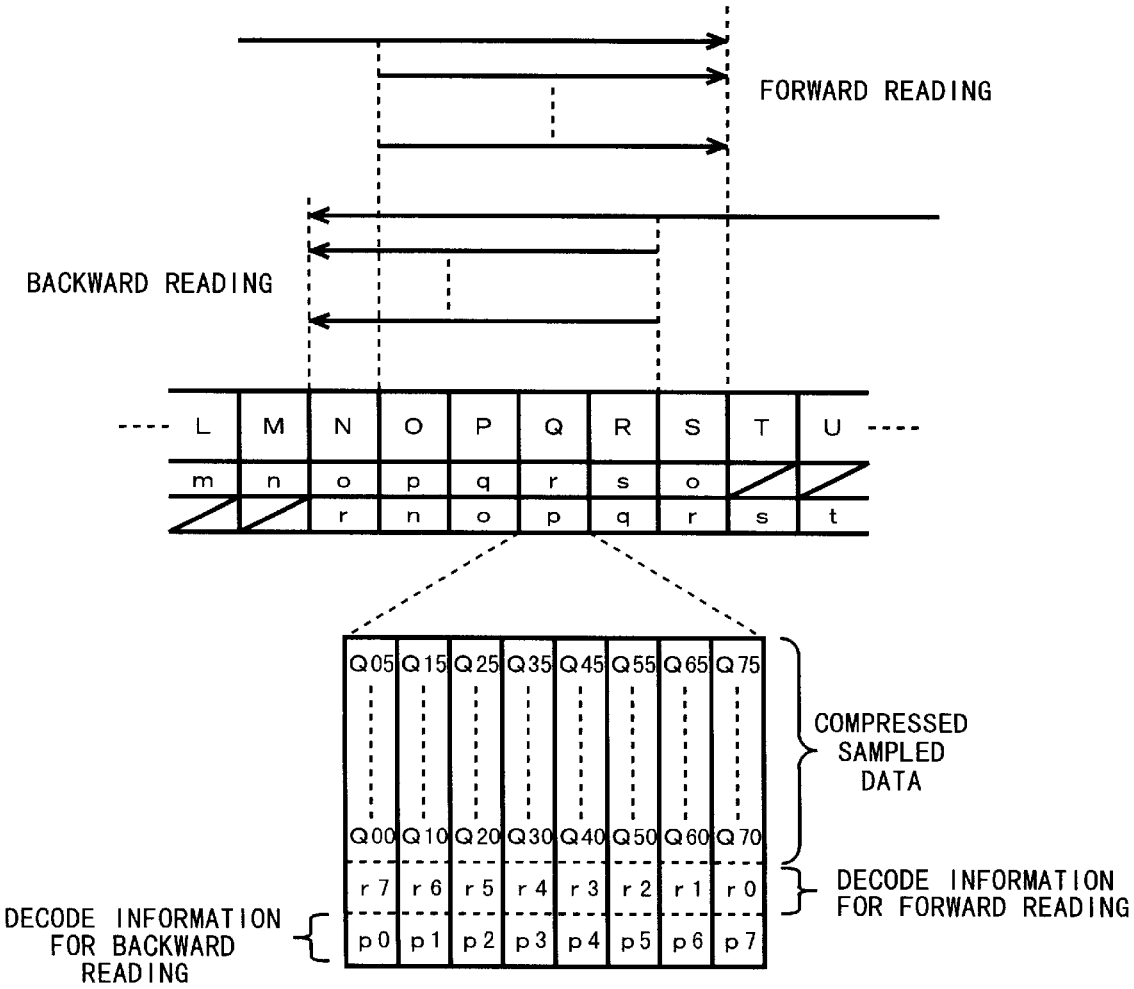
FIG. 3 is a diagram illustrating a data configuration in a waveform memory compatible with both forward and backward data reading schemes.

FIG. 3 describes the data configuration of the waveform memory compatible with both of forward and backward reading schemes. In this example, each frame holds the decode information for both forward and backward reading schemes. For example, the frame Q holds two of the decode information r and p for the frames R and P immediately before and after the frame Q in a format shown. The decoder extracts and uses one of these two pieces of decode information according to the required reading direction. In each division including frame M and frames preceding the same, and frame T and frames succeeding the same, namely the division not for repeatedly reading, only one piece of decode information is required, so that one more bit may be allocated to compressed sampled data in each of the frames in such a division. However, decoding these frames requires information that indicates this division.

Figure 4:
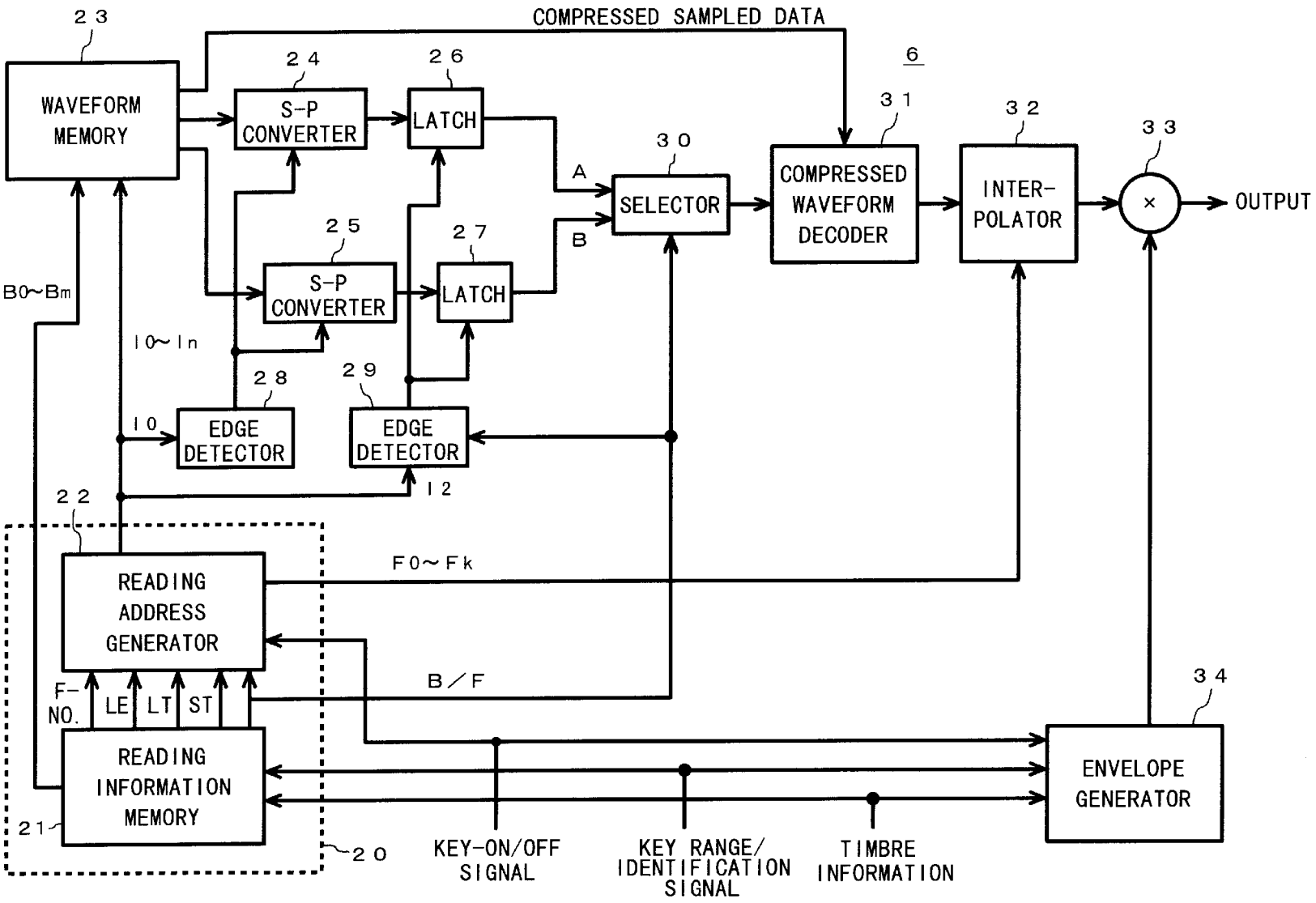
FIG. 4 is a block diagram illustrating a tone generator used in the embodiment of FIG. 2.

Referring to FIG. 4, there is shown a block diagram illustrating the tone generator 6 of FIG. 2 corresponding to the waveform data shown in FIG. 3. A waveform reader 20 comprises a reading information memory 21 for storing various parameters such as a frequency (F) number and a reading start address ST which are set by the CPU 1, and a reading address generator 22. The reading address generator 22 receives the above-mentioned parameters from the reading information memory 21 and accumulates frequency numbers to sequentially generate addresses for reading the waveform data out of the memory in the direction indicated by the arrow shown in FIG. 3, for example. For the reading address generator 22, any of known circuits designed for the purpose may be used. For example, a parameter signal generator provided by the inventor of the present invention and disclosed in Japanese Layed Open Patent Publication No. Hei 2-282297 may be used.

A reading address of waveform memory 23 consists of an integer part I0 through In and a fraction part F0 through Fk. The integer is used as a waveform memory reading address, while the fraction part is outputted to an interpolator 32. In the present embodiment, the sampling frequency and the like of the waveform memory 23 are set such that the frequency number becomes less than 1, thereby preventing the skipping in reading of the sampled waveform value from being caused by increasing or decreasing in the integer part of the reading address by 2 or more at a time. This setting is made because, in the case of data compression scheme based on differential data, the compressed sampled data should be decoded only one by one in fixed order to restore the original data.

The waveform memory 23 stores the compressed sampled data and decode information as shown in FIG. 3, for example, for each timbre and key range. The waveform data specified by higher-order addresses B0 through Bm corresponding to timbre information and key range information (a key identification signal) are read out of the waveform memory 23, according to the reading address integer part I0 through In and outputted. Of the waveform data read out, the compressed sampled data (6 bits) is inputted in a compressed waveform decoder 31. The predictive/quantization data (1 bit) for forward direction reading, namely the decode information, is inputted in an S-P (Serial-Parallel) converter 24 comprising of an 8-bit shift register. The predictive/quantization data (1 bit) for backward direction reading is inputted in another S-P converter 25.

An edge detector 28 generates a pulse signal at each of the rising edge and the falling edge of the address I0 read out. Both the converters 24 and 25 read in the decode information bit by bit and shift the bits read in according to the generated pulses. An edge detector 29 receives the address 12 and a reading direction signal B/F ("0" in forward reading direction and "1" in backward reading direction) and generates a latch pulse at the falling edge of the address 12 in case of the forward reading direction, or at the rising edge of the address 12 in case of the backward reading direction. Latches 26 and 27 are an 8-bit latch circuit each, holding the output data coming from the S-P converters 24 and 25 respectively, according to the latch pulse coming from the edge detector 29. A selector 30 outputs the content (A) of the latch 26 when the reading direction signal B/F is "0" (forward direction), while the content (B) of the latch 27 when the reading direction signal B/F is "1" (backward direction).

Figure 5:
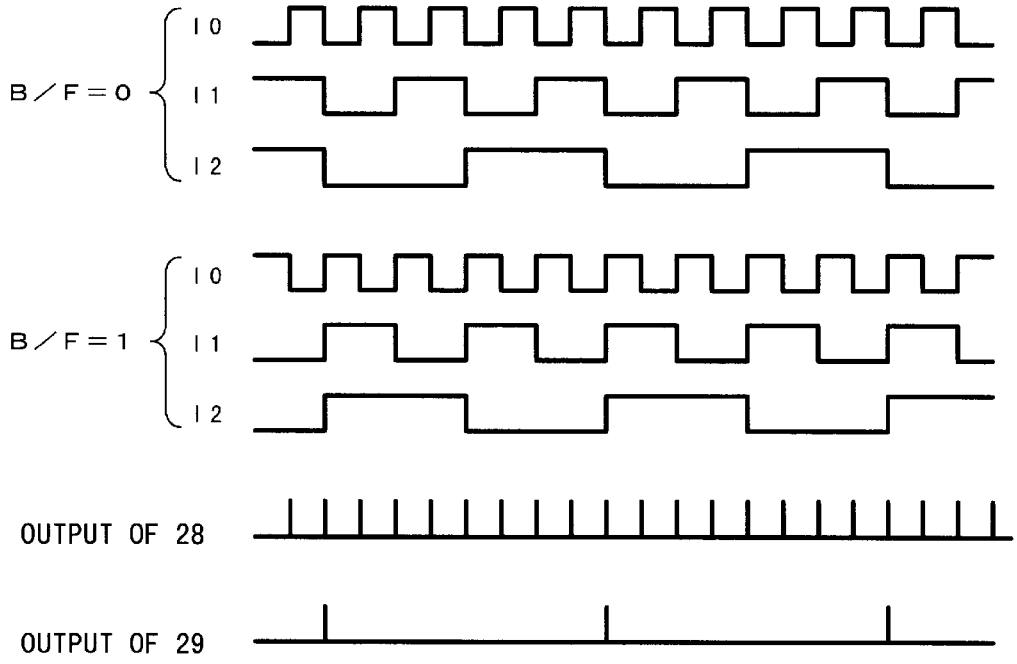
FIG. 5 is a timing chart indicating an address signal and a pulse signal generated by an edge detector.

FIG. 5 shows a waveform diagram illustrating the timings of the address signals I0, I1 and I2 and the pulses generated by the two edge detectors 28 and 29. When the shift pulse to the S-P converters and the latch pulse to the latches are generated in the timings shown, the 8-bit decode information adapted to the reading direction is supplied to the compressed waveform decoder 31 immediately before a next frame is processed.

Figure 6:
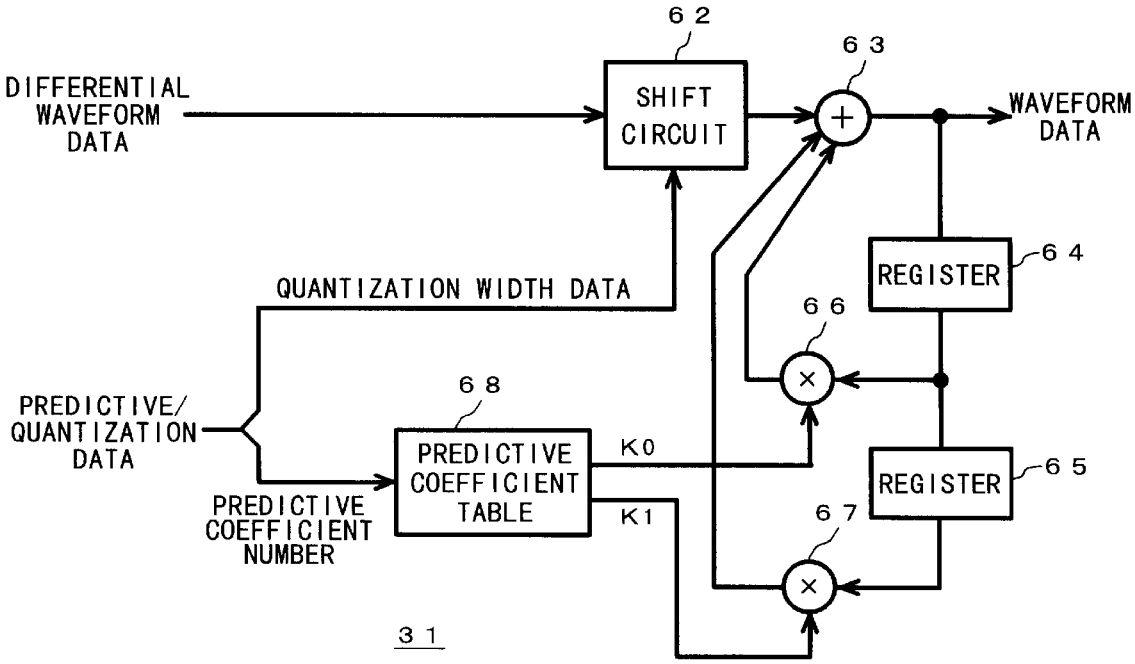
FIG. 6 is a block diagram of a decoder for a compressed waveform.

The compressed waveform decoder 31 restores or extend the compressed sampled value data to the original value thereof. FIG. 6 shows a block diagram illustrating the compressed waveform decoder 31 by way of example. The decoder restores the sampled waveform value compressed by adaptive differential pulse code modulation (ADPCM), namely differential waveform data. As the decode information, a predictive coefficient number (4 bits) for selecting one of the predictive coefficients of n types (n=16 in the present embodiment) and quantization width data (4 bits) for controlling quantization widths (16 types in the present embodiment) are supplied to the decoder 31.

The differential waveform data read out of the waveform memory 23 (FIG. 4) is inputted in a shift circuit 62. Based on the quantization width data, the shift circuit 62 shifts the inputted differential waveform data, adjusts the number of digits for restoring the magnitude thereof to the original differential value. The sampled waveform values have been differentially coded and the resultant values have been divided into the frames. If the maximum absolute value of the differential data in a frame is "000110.101 . . . " for example, the entire differential data is left-shifted by 3 bits to be "110101 ", using all of 6 bits as valid data. In this case, as well known, the left shift by 3 bits is equivalent to raising the quantization width to the third power, or multiplying the quantization width by 8, and "3" is stored for the quantization width data. If the quantization width data is "3", therefore, the decoder 31 shifts the differential sampled value to the right (or down-words) by 3 bits, namely decreases the differential sampled value to ⅛ and outputs the resultant value.

An adder 63, registers 64 and 65 each for holding the data delayed by one sampling period, and multipliers 66 and 67 for multiplying the data held in the registers 64 and 65 by predictive coefficients K0 and K1, respectively, constitute a known differential decoder. At the output of the adder 63, there appear the waveform data at the current point of time obtained by extending the inputted differential waveform data. The predictive coefficients K0 and K1 are supplied from the predictive coefficient table 68. The predictive coefficient table 68 contains predetermined combinations of the predictive coefficients K0 and K1.

When differentially coding a sampled waveform value, a selection of a combination of the predictive coefficients K0 and K1 that minimizes a differential value the absolute value of which is largest among a plurality of differential values included in one frame and the combination number thus selected is stored as the predictive coefficient information. Using the predictive coefficient number information in the decode information read out of the waveform memory 23 as the address, the predictive coefficient values K0 and K1 are read out of the predictive coefficient table 68. When the reading direction is inverted, the waveform phase is inverted by 180 degrees; this is desirable in an aspect of the waveform continuity.

Referring to FIG. 4 again, the interpolator 32 temporarily stores the necessary number of sampled waveform values outputted from the compressed waveform decoder 31 for interpolation calculation and performs a known interpolating operation based on the reading address fraction part data F0 through Fk outputted from the reading address generator 22. Receiving various parameters necessary for envelope generation from the CPU 1, an envelope generator 34 generates an envelope signal that corresponds to these parameters. A multiplier 33 multiplies the waveform data outputted from the interpolator 32 by the envelope signal to generate a resultant musical tone signal.

According to the above-mentioned embodiment, the memory capacity is decreased by storing the compressed sampled values in the waveform memory, while the waveform data can be read out in either of the forward and backward directions.

Figure 7:
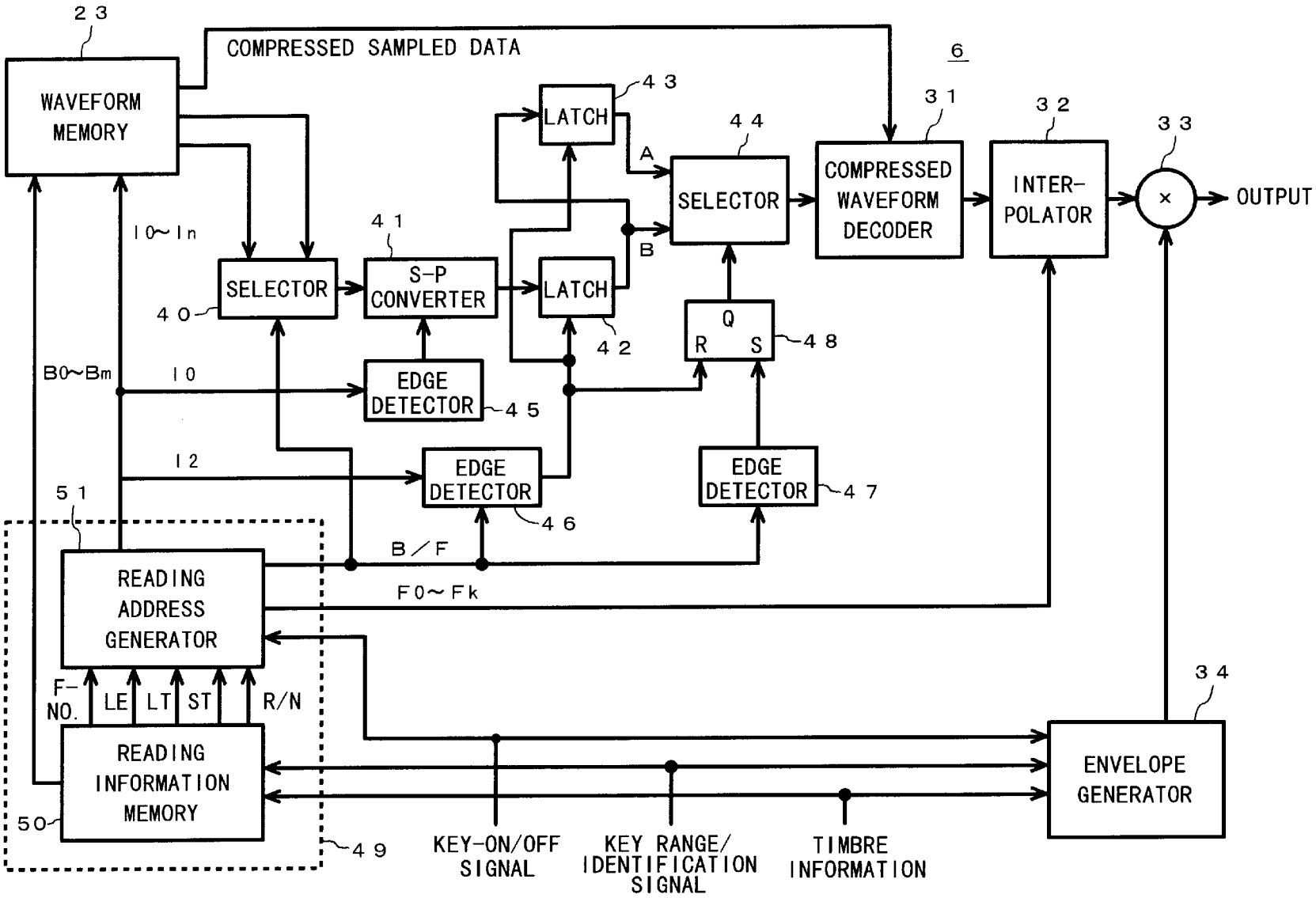
FIG. 7 is a block diagram illustrating the tone generator according to a second preferred embodiment of the present invention shown in FIG.2.
Figure 9:
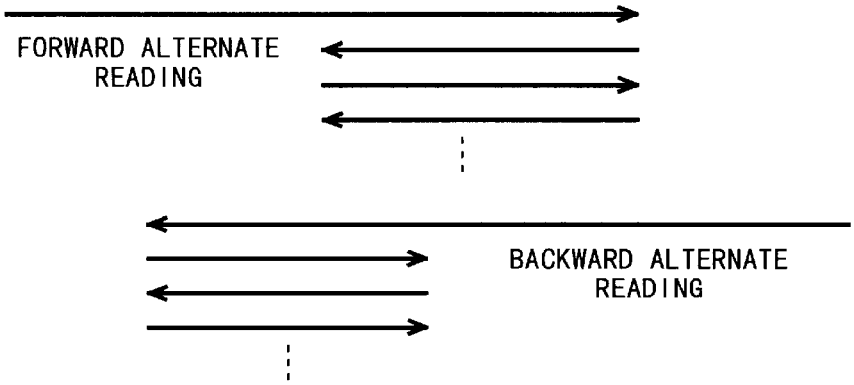
FIG. 9 is a diagram illustrating an alternate reading scheme.

FIG. 7 is a block diagram illustrating the tone generator 6 practiced as the second preferred embodiment of the present invention. In the second embodiment, the waveforms such as shown in FIG. 3 can be read alternately as shown in FIG. 9. In forward alternate reading, first the waveform data is read from the beginning to the end thereof, then it is read in backward from the end thereof to the start point of the repetitive division and, when the start point of the repetitive division is reached, the waveform data is read forward to the end of the repetitive division.

Referring to FIG. 7, components similar to those previously described with FIG. 4 are denoted with the same reference numerals. A difference from the first embodiment shown in FIG. 4 lies in that a reading address generator 51 sequentially generates the addresses indicated by the arrows in FIG. 9. Accordingly, data of the frames shown in FIG. 8(*a*) is read out of the waveform memory 23. This example shows in case of the forward reading (namely, normal alternate reading with R/N="0"). In FIG. 7, a selector 40 is controlled by the B/F signal which is "0" when the address increases, while "1" when the address decreases; in forward reading (B/F="0"), for example, the selector 40 outputs the forward decode information.

An S-P converter 41 performs serial-to-parallel conversion on the decode information as with the first embodiment and outputs the resultant information to a latch 42. An edge detector 45 generates a pulse at both of the rising and falling edges of I0, namely every time new data is read out of the waveform memory 23. An edge detector 46 generates a latch pulse at the falling edge of I2 when the B/F signal is "0", while at the rising edge when the B/F signal is "1". This latch pulse causes the latch 42 to latch an output signal of the S-P converter 41 and the latch 43 to latch an output of the latch 42.

An edge detector 47 generates a pulse at both the rising and falling edges of the B/F signal, the resultant pulse setting an RS flip-flop 48. The RS flip-flop 48 is reset by the output pulse of the edge detector 46. A selector 44 selects the output (A) of the latch 43 if the output Q of the RS flip-flop 48 is "1", while output (B) of the latch 42 if the output Q is "0".

Figure 8:
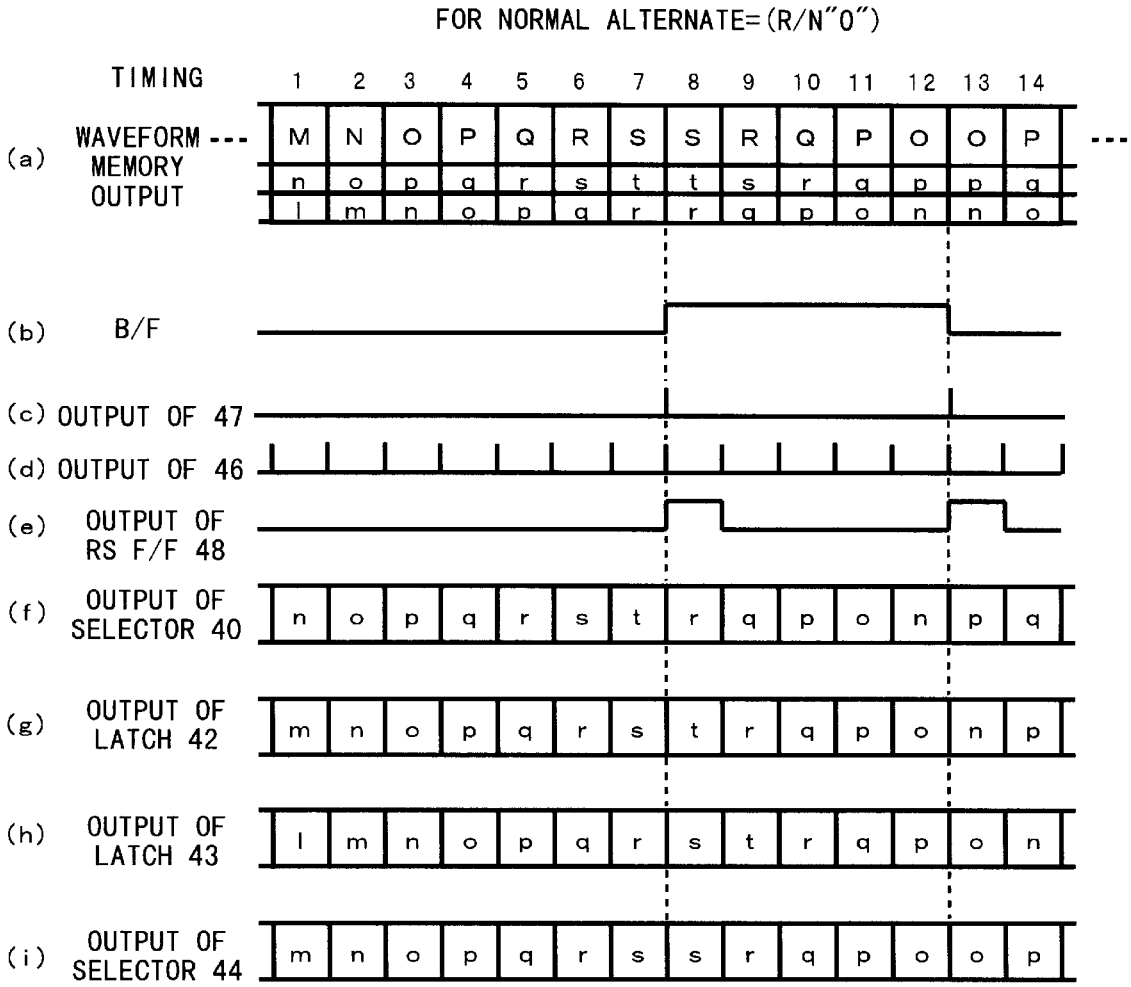
FIG. 8 is a timing chart of the signals of the main portion of the tone generator shown in FIG. 7.

FIG. 8 is a timing chart of the signals of the main portion of the tone generator shown in FIG. 7. The waveform memory stores the substantially same frames as shown in FIG. 3; in the case of normal alternate reading (R/N="0"), the division containing the frames O through S is read out repeatedly. At the start of the reading, B/F(b) is "0" and, as shown in (a) of FIG. 8, the frames up to frame S are sequentially read out until the timing 7 during which the decode information for forward direction is outputted bit by bit, at the output (f) of the selector 40. The output (g) of the latch 42 is the parallel decode information latched with one frame delayed behind the output (f). The output (h) of the latch 43 is the decode information delayed one more frame behind the output (g).

Initially, the output Q of the RS flip-flop 48 is "0", so that the output (i) of the selector 44 is the same as the output (g) as shown in FIG. 8, outputting the decode information in forward direction to the compressed waveform decoder 31 is synchronized with the compressed waveform data in the output (a). When the reading of frame S of the compressed wave form data is completed at timing 7, the B/F signal (b) outputted from the reading address generator 51 is changed to "1", outputting a pulse (c) from the edge detector 47 at timing 8. This causes the RS flip-flop 48 to be set, upon which the output Q (e) is changed to "1" for causing the selector 44 to select the decode information s, or the output (h) of the latch 43. It should be noted that the present embodiment is constituted such that the address 12 does not change but the edge detector 46 generates the pulse at the moment of the direction inversion.

At the next timing 9, the pulse from the edge detector 46 resets the RS flip-flop 48, so that the selector 44 selects the output of the latch 42. It should be noted that, because the B/F signal is still "1", the content of the latch 42 is the backward decode information r.

Subsequently, a train of the backward decode informations q, p and so on are outputted up to timing 12 for frame 0 and, at timing 13 and thereafter, a train of the forward decode informations n, o and so on are outputted again.

Although description of the backward alternate reading will be omitted herein, it will be easily understood from the above description on the forward alternate reading. Thus, according to the present embodiment, both of the forward and backward alternate reading schemes are enabled by the above-mentioned constitution.

Variations that follow can be added to the present invention by way of example. In the above-mentioned embodiments, only 6 (or 7) bits of sampled waveform values are provided. It will be apparent, however, that any number of bits and any number of words (samples) in one frame may be selected. For example, if the number of words is set to 16, the same forward and the backward decode informations (each 8 bits) mentioned above can be stored by using only one bit in each word, so that the number of bits for differential waveform data can be increased by one in each word. Further, if the number of words is set to 32, it is enough to use only one bit in every other word for storing the decode information (2×8 bits). Therefore, increasing the number of words (samples) in one frame increases the number of bits for differential waveform data that can be stored in one word, thereby reducing the noise caused by quantization.

As an example of the decode information, the predictive/quantization data consisting of 4 bits of quantization width data and 4 bits of predictive coefficient information has been described above.

It will be apparent that any number of bits may be used for these pieces of data and information. It will also be apparent that the predictive coefficient may be predetermined and fixed with only the quantization width data stored in each frame.

Because it takes time to read decode information out of the waveform memory 23 at the start of sounding, the decode information at the start of sounding may be stored for each waveform in another memory beforehand, the decode information thus stored being read out by the CPU 1 to be written into the latches 26 and 27, thereby quickening the reading thereof. Alternatively, the decode information at the start of sounding may be stored as a fixed value common to all pieces of waveform data. In the above-mentioned embodiments of the present invention, differential coding method is used for data compression. It will be apparent that, however, any kind of data compression method may be used in which the compressed data is restored to the original form thereof based on the corresponding decode information.

As described and according to the present invention, the PCM waveform data is stored in a compressed form, requiring a memory of a relatively small capacity for storing generally the same musical tone waveform information as that stored in conventional electronic musical instruments. In addition, the decode information necessary for extending the compressed data is stored in an adjacent data block, for example, in the memory such that the data necessary for reproduction are always ready when the data block is extended. Therefore, if the decode information for both compressed sampled data in the preceding and succeeding blocks is stored in a data block, whether read forward or backward, the decode information necessary for extending the compressed sampled waveform data held in a data block can be extracted from the data held in a data block read out immediately before that data block, thereby providing compatibility with any data reading scheme.

Further, the decode information is not necessarily stored in data blocks immediately preceding and succeeding the current data block; the decode information may be stored in data blocks second or more preceding or succeeding the current data block, by way of example.

While the preferred embodiments of the present invention have been described using specific terms, such description is for illustrative purposes only, and it is to be understood that changes and variations may be made without departing from the spirit or scope of the appended claims.

What is claimed is:

1. An electronic musical instrument that generates a musical tone waveform signal, the instrument comprising:

waveform storing means; and waveform information stored in said waveform storing means;

wherein said waveform information stored in said waveform information storing means comprises a plurality of frames, and wherein each of said plurality of frames includes a plurality of pieces of compressed sampled waveform data and decoding information, for extending another plurality of pieces of compressed sampled data contained in another one of said plurality of frames which is read out of the waveform storing means after said each of said plurality of frames.

2. The electronic musical instrument as claimed in claim 1 wherein each of said plurality of frames comprises a plurality of words, each of said plurality of words includes one piece of compressed sampled waveform data and a part of a plurality of bits that constitute said decoding information.

3. The electronic musical instrument as claimed in claim 1, wherein said decoding information comprises a plurality of bits which are stored in a distributed manner in a plurality of words in a frame of said plurality of frames stored in said waveform information storing means.

4. The electronic musical instrument as claimed in claim 1, wherein said plurality of frames continuously store time-sequential sampled values of a tone generated by an acoustic musical instrument, each of said plurality of frames storing decoding information for extending the compressed sampled waveform data stored in another frame of said plurality of frames that precedes said each of said plurality of frames.

5. The electronic musical instrument as claimed in claim 1, wherein said plurality of frames continuously store time-sequential sampled values of a tone generated by an acoustic musical instrument, each of said plurality of frames storing decoding information for extending the compressed sampled waveform data stored in another frame of said plurality of frames that follows said each of said plurality of frames.

6. The electronic musical instrument as claimed in claim 1 further comprising:

reading means for reading out the waveform information frame by frame;

extracting means for separately extracting the compressed sampled waveform data and the decoding information from the waveform information read out; and extending means for extending the extracted compressed sampled waveform data of said each of said plurality of frames by use of decoding information extracted from a second one of the plurality of frames previously read out, said decoding information extracted from a second one of the plurality of frames previously read out corresponding to said compressed sampled waveform data extracted from the waveform information of said each of said plurality of frames.

7. The electronic musical instrument as claimed in claim 1 wherein each of the plurality of frames includes decoding information for extending the compressed sampled waveform data contained in one of the plurality of frames adjacent said each of the plurality of frames in a forward direction, and decoding information for extending the compressed sampled waveform data contained in one of the plurality of frames adjacent said each of the plurality of frames in a backward direction.

8. The electronic musical instrument as claimed in claim 7 further comprising:

extending means for extending the compressed sampled waveform data of said each of the plurality of frames by use of decoding information extracted from a second one of the plurality of frames previously read out, said decoding information extracted from a second one of the plurality of frames previously read out corresponding to said compressed sampled waveform data extracted from the waveform information of said each of the plurality of frames.

9. An electronic musical instrument that for generating a musical tone waveform signal, the instrument comprising:

electronic memory for storing waveform information, wherein said waveform information comprises a plurality of frames stored in a sequence in the electronic memory, and wherein each of the plurality of frames includes compressed sampled waveform data and decoding information, the decoding information being adapted to decompress the compressed sampled waveform data contained in another one of the plurality of frames in the sequence.

10. The electronic musical instrument according to claim 9 wherein the decoding information contained in said each of the plurality of frames comprises decoding information adapted to decompress the compressed sampled waveform data contained in one of the plurality of frames that precedes said each of the plurality of frames in the sequence.

11. The electronic musical instrument according to claim 9 wherein the decoding information contained in said each of the plurality of frames comprises decoding information adapted to decompress the compressed sampled waveform data contained in one of the plurality of frames that follows said each of the plurality of frames in the sequence.

12. The electronic musical instrument according to claim 9 wherein the decoding information contained in each of the plurality of frames comprises decoding information for decompressing the compressed sampled waveform data contained in one of plurality of frames forward in the sequence from said each of the plurality of frames, and decoding information for decompressing the compressed sampled waveform data contained in one of plurality of frames backward in the sequence from said each of the plurality of frames.

13. The electrical musical instrument according to claim 9 further comprising:

decompressing means for decompressing the compressed sampled waveform data of said each of the plurality of frames by use of decoding information extracted from another one of the plurality of frames in the sequence.

14. The electrical musical instrument according to claim 12 further comprising:

decompressing means for decompressing the compressed sampled waveform data of said each of the plurality of frames by use of decoding information extracted from another one of the plurality of frames in the sequence.

15. A method for generating a musical tone waveform signal using an electronic musical instrument, the method comprising the steps of:

providing waveform information to the electronic musical instrument, wherein the waveform information comprises a plurality of frames in a sequence, each of the plurality of frames including compressed sampled waveform data and decoding information, the decoding information being adapted to decompress the compressed sampled waveform data contained in another one of the plurality of frames in the sequence;

storing the waveform information in electronic memory of the electronic musical instrument;

reading the waveform information out of the electronic memory; and decompressing the compressed sampled waveform data contained in each of the plurality of frames using the decoding information contained in one of the plurality of frames previously read out of the electronic memory.

16. The method according to claim 15 wherein the decompressing step comprises decompressing the compressed sampled waveform data contained in each of the plurality of frames using the decoding information contained in one of the plurality of frames that precedes said each of the plurality of frames in the sequence.

17. The method according to claim 15 wherein the decompressing step comprises decompressing the compressed sampled waveform data contained in each of the plurality of frames using the decoding information contained in one of the plurality of frames that follows said each of the plurality of frames in the sequence.

18. The method according to claim 15 wherein the decoding information contained in each of the plurality of frames comprises decoding information for decompressing the compressed sampled waveform data contained in one of plurality of frames forward in the sequence from said each of the plurality of frames, and decoding information for decompressing the compressed sampled waveform data contained in one of plurality of frames backward in the sequence from said each of the plurality of frames, and wherein the decompressing step comprises decompressing the compressed sampled waveform data in either a forward direction or a backward direction.

* * * * *